US008092262B1

(12) United States Patent
Frederick et al.

(10) Patent No.: US 8,092,262 B1
(45) Date of Patent: Jan. 10, 2012

(54) EYE-OF-THE NEEDLE PIN OF AN ELECTRICAL CONTACT

(75) Inventors: Robert Todd Frederick, Enola, PA (US); Michael Joseph Vino, Landisville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/905,714

(22) Filed: Oct. 15, 2010

(51) Int. Cl.
*H01R 13/42* (2006.01)

(52) U.S. Cl. ..... 439/751; 439/877; 439/943

(58) Field of Classification Search ..... 439/751, 439/877, 943
See application file for complete search history.

(56) References Cited

U.S. PATENT DOCUMENTS 4,186,982 A 2/1980 Cobaugh et al.
4,735,575 A * 4/1988 Shaffer ..... 439/82
4,763,408 A 8/1988 Heisey et al.
4,997,379 A * 3/1991 Rozmus ..... 439/84
5,564,954 A * 10/1996 Wurster ..... 439/751
5,664,970 A 9/1997 Millhimes et al.
5,823,830 A 10/1998 Wurster
5,916,000 A * 6/1999 Feldmeier et al. ..... 439/751
5,944,538 A 8/1999 Sorig
6,077,128 A 6/2000 Maag et al.
7,008,272 B2 3/2006 Blossfeld
7,074,094 B2 7/2006 Kawahara et al.
7,445,499 B2 * 11/2008 Nunokawa et al. ..... 439/567
2008/0318453 A1 12/2008 Dancison

* cited by examiner

*Primary Examiner* — James Harvey

(57) ABSTRACT

An electrical contact includes a base and an eye-of-the needle (EON) pin extending a length outwardly from the base to a tip. The EON pin is configured to be received within an electrical via. The EON pin includes a neck segment that extends outwardly from the base, a tip segment that includes the tip, and a compliant segment that extends from the neck segment to the tip segment. The neck segment has opposite end walls and opposite side walls that extend between the end walls. The end walls are connected to the side walls at corresponding transitional walls that interconnect spaced-apart edges of the corresponding end and side walls.

19 Claims, 6 Drawing Sheets

EYE-OF-THE NEEDLE PIN OF AN ELECTRICAL CONTACT

BACKGROUND OF THE INVENTION

The subject matter described and/or illustrated herein relates generally to electrical contacts, and more particularly, to electrical contacts that include eye-of-the needle (EON) pins for mounting the electrical contact on a printed circuit.

In electronic systems that include printed circuits (sometimes referred to as "circuit boards" or "printed circuit boards"), the printed circuit is typically electrically connected to another electrical device, such as another printed circuit, an electrical cable, an electrical power source, and/or the like. The printed circuit may be electrically connected directly to the other electrical device or may be electrically connected to the other electrical device through an intervening electrical connector. Many printed circuits are electrically connected to other electrical devices using electrical contacts of the other electrical device or the intervening electrical connector that include EON pins that are received within electrical vias of the printed circuit. Specifically, the EON pins include compliant segments that deform as the EON pin is inserted into the electrical via. The compliant segment engages an electrically conductive material on the interior wall of the electrical via to establish an electrical connection between the electrical via and the EON pin.

As electronic systems become smaller, the signal paths thereof become more densely grouped. Moreover, the rate at which the electrical data signals propagate along the signal paths is continually increasing to satisfy the demand for faster electronic systems. There is a demand for reducing the size of the electrical vias within printed circuits to satisfy the increased density and/or higher signal rates. For example, smaller electrical vias can be more densely grouped on the printed circuit. Moreover, and for example, smaller electrical vias may have better electrical performance (e.g., less interference with neighboring electrical vias) than larger electrical vias, which may enable the smaller electrical vias to carry a higher signal rate.

As electrical vias within printed circuits are made smaller, the EON pins must also be reduced in size to fit into such smaller electrical vias. But, such smaller EON pins may not retain enough structural rigidity to resist buckling as the EON pin is inserted into the electrical via. For example, EON pins of electrical contacts include a neck segment that extends between, and interconnects, the compliant segment to a base of the electrical contact. In addition to the compliant segment, the neck segment is also reduced in size to fit into a smaller electrical via. The neck segment may become so small that the force required to insert the compliant segment into the electrical via exceeds the structural rigidity of the neck segment. Accordingly, the EON pin may buckle about the neck segment and thereby fold over the printed circuit instead of sliding into the electrical via, which may result in a poor or no electrical connection between the EON pin and the electrical via.

BRIEF DESCRIPTION OF THE INVENTION

In one embodiment, an electrical contact includes a base and an eye-of-the needle (EON) pin extending a length outwardly from the base to a tip. The EON pin is configured to be received within an electrical via. The EON pin includes a neck segment that extends outwardly from the base, a tip segment that includes the tip, and a compliant segment that extends from the neck segment to the tip segment. The neck segment has opposite end walls and opposite side walls that extend between the end walls. The end walls are connected to the side walls at corresponding transitional walls that interconnect spaced-apart edges of the corresponding end and side walls.

In another embodiment, an electrical contact includes a base and an eye-of-the needle (EON) pin extending a length outwardly from the base to a tip. The EON pin is configured to be received within an electrical via. The EON pin includes a neck segment that extends outwardly from the base, a tip segment that includes the tip, and a compliant segment that extends from the neck segment to the tip segment. The neck segment has opposite end walls and opposite side walls that extend between the end walls. The end walls are connected to the side walls at corresponding transitional walls that define corners between the corresponding end and side walls. The corners include at least one of a round, a fillet, or a chamfer.

In another embodiment, an electrical contact includes a base and an eye-of-the needle (EON) pin extending a length outwardly from the base to a tip. The EON pin is configured to be received within an electrical via. The EON pin includes a neck segment that extends outwardly from the base, a tip segment that includes the tip, and a compliant segment that extends from the neck segment to the tip segment. A cross section taken through the neck segment in a direction perpendicular to the length of the EON pin is non-rectangular.

DETAILED DESCRIPTION OF THE INVENTION

Figure 1:
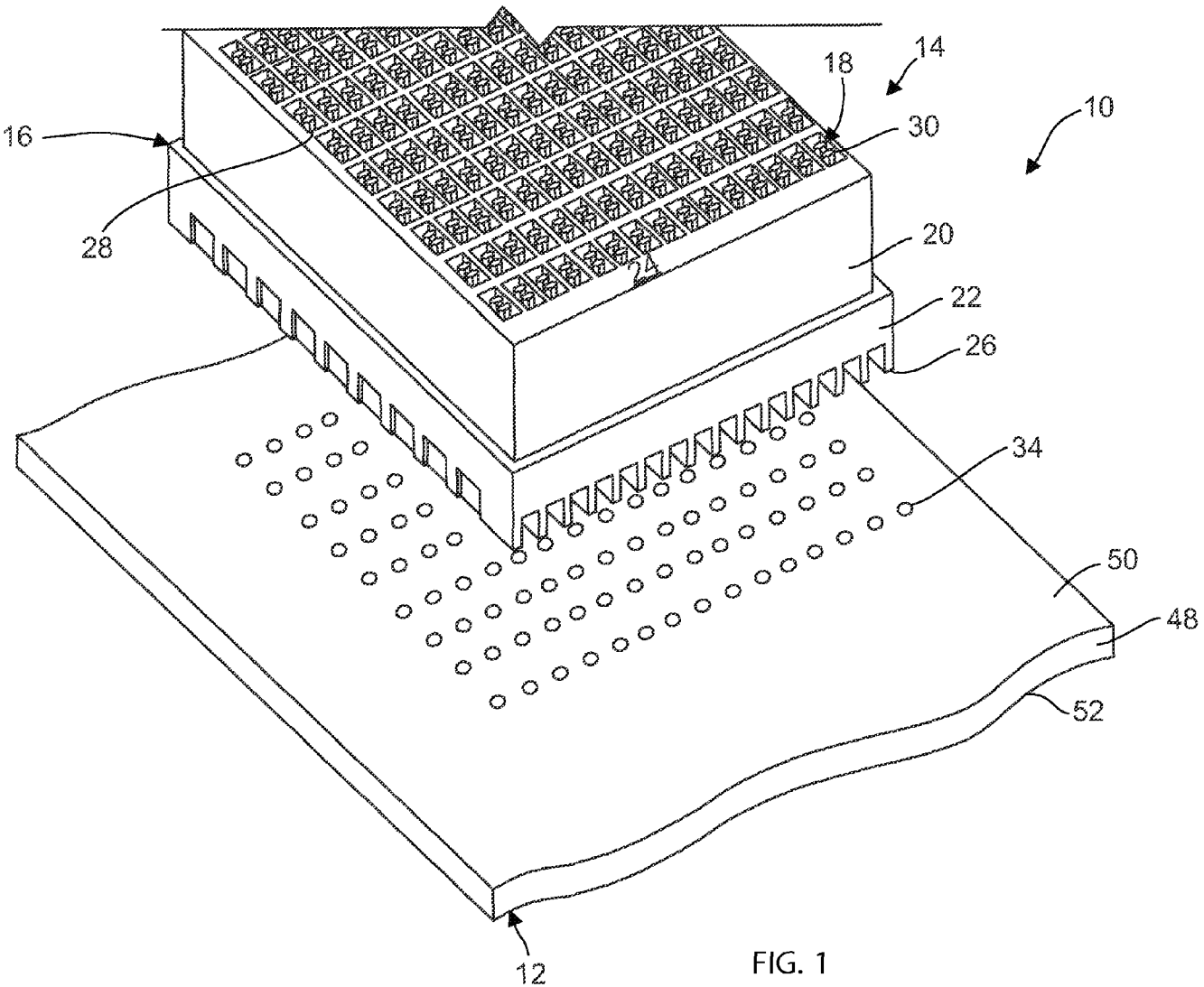
FIG. 1 is a partially exploded perspective view of an exemplary embodiment of an electrical connector and printed circuit assembly.

FIG. 1 is a partially exploded perspective view of an exemplary embodiment of an electrical connector and printed circuit assembly 10. The assembly 10 includes a printed circuit 12 and an electrical connector 14. The electrical connector 14 is configured to be mounted on the printed circuit 12 such that the electrical connector 14 is electrically connected to the printed circuit 12. The electrical connector 14 is used to electrically connect the printed circuit 12 to any other electrical device (not shown), such as, but not limited to, another printed circuit, an electrical cable, an electrical power source, and/or the like. In the exemplary embodiment, the electrical connector 14 mates with a complementary mating connector (not shown) mounted on the other electrical device to establish an electrical connection between the printed circuit 12 and the other electrical device. Alternatively, the electrical connector 14 mates directly with the other electrical device to electrically connect the printed circuit 12 to the other electrical device without the use of an intervening mating connector.

The electrical connector 14 includes a housing 16 that holds a plurality of electrical contacts 18. The housing 16 includes a mating segment 20 and a mounting segment 22. The mating segment 20 mates with the mating connector and includes a mating face 24, while the mounting segment 22 includes a mounting face 26. A plurality of ports 28 extend through the mating face 24 for exposing mating segments 30 of the electrical contacts 18. In the exemplary embodiment, the mating segments 30 of the electrical contacts 18 mate with mating contacts (not shown) of the mating connector to electrically connect the electrical connector 14 to the mating connector. The mating segment 20 of the housing 16 optionally defines a plug that is configured to be received within a receptacle (not shown) of the mating connector. In the exemplary embodiment, the mating and mounting faces 24 and 26, respectively, extend opposite, and thus approximately parallel, to each other. Alternatively, the mating and mounting faces 24 and 26, respectively, extend at any other angle relative to each other, such as an approximately perpendicular angle or an oblique angle. The electrical connector 14 may include any number of the electrical contacts 18.

Figure 2:
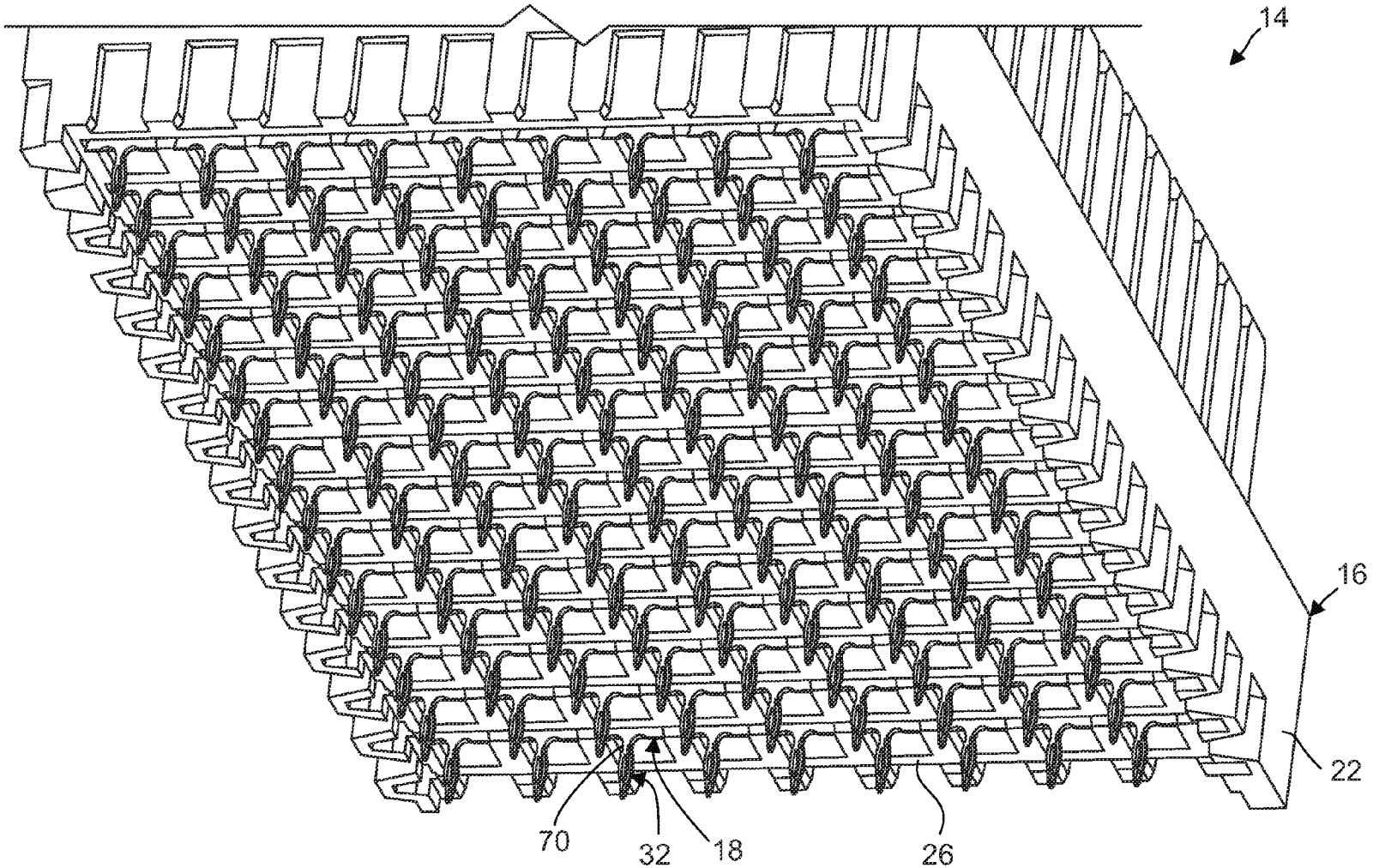
FIG. 2 is a perspective view of an exemplary embodiment of the electrical connector shown in FIG. 1.

FIG. 2 is a perspective view of an exemplary embodiment of the electrical connector 14. FIG. 2 illustrates the mounting segment 22 and the mounting face 26 of the housing 16. The mounting segment 22 is configured to be mounted on the printed circuit 12 (FIG. 1). Optionally, the mounting face 26 engages the printed circuit 12 when the electrical connector 14 is fully mounted on the printed circuit 12. The electrical contacts 18 include eye-of-the needle (EON) pins 32 that extend outwardly along the mounting face 26 of the housing 16. When the electrical connector 14 is mounted on the printed circuit 12, the EON pins 32 are received within corresponding electrical vias 34 (FIGS. 1 and 6) of the printed circuit 12 to electrically connect the electrical contacts 18 to the printed circuit 12.

The electrical contacts shown and/or described herein (e.g., the electrical contact 18) are components of the electrical connector 14. But, the electrical contacts shown and/or described herein may alternatively be components of the other electrical device that electrically connects to the printed circuit 12. Moreover, the EON pins shown and/or described herein (e.g., the EON pins 32, 232, and 332) are not limited to being used with the electrical connector 14. Rather, the electrical connector 14 shown and described herein is meant as exemplary only. The EON pins shown and/or described herein may be used with any other type of electrical connector and may be used with electrical connectors having different geometries, configurations, and/or the like than the electrical connector 14.

Referring again to FIG. 1, the printed circuit 12 includes a substrate 48 having a pair of opposite sides 50 and 52. The electrical connector 14 mounts onto the side 50 of the substrate 48. The printed circuit 12 includes the electrical vias 34, which extend into the side 50 of the substrate 48. The electrical vias 34 are defined by openings within the substrate 48 that have interior walls that include an electrically conductive material thereon, such that the electrical vias 34 are electrically conductive. The electrical vias 34 are optionally electrically connected to electrical circuits (not shown) of the printed circuit 12, electrical components (not shown) of the printed circuit 12, and/or the like. Each electrical via 34 receives the EON pin 32 (FIGS. 2-6) of a corresponding electrical contact 18 of the electrical connector 14 therein. The printed circuit 12 may include any number of the electrical vias 34 for receiving any number of EON pins 32 of the electrical connector 14. Each electrical via 34 may extend completely through the substrate 48 or may extend into the side 50 only partially through the substrate 48.

Figure 3:
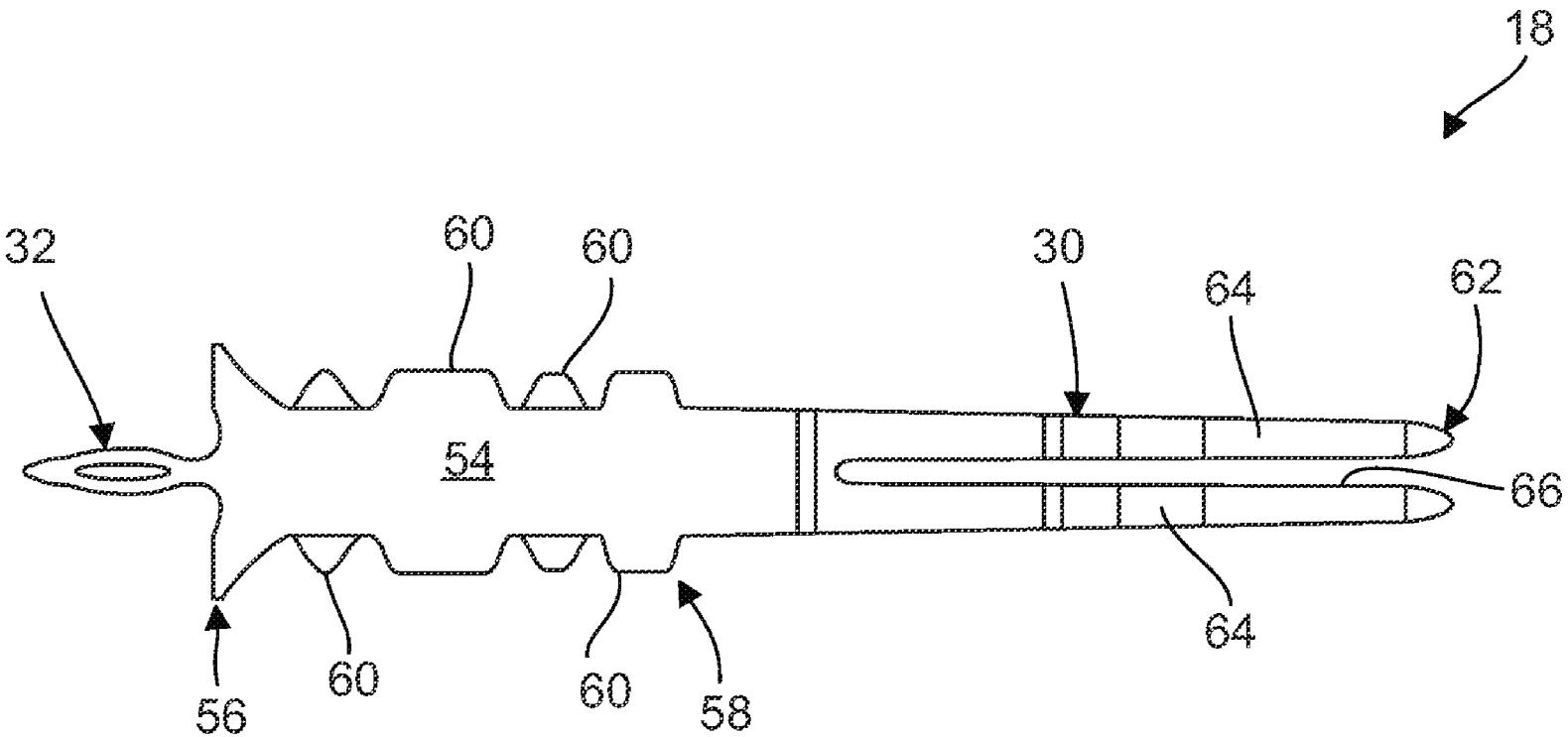
FIG. 3 is a plan view of an exemplary embodiment of an electrical contact of the electrical connector shown in FIGS. 1 and 2.

FIG. 3 is a plan view of an exemplary embodiment of one of the electrical contacts 18. The electrical contact 18 includes a base 54, the mating segment 30, and the EON pin 32. The base 54 extends a length from an end 56 to an opposite end 58. The EON pin 32 extends outwardly from the end 56 of the base 54. The mating segment 30 extends outwardly from the end 58 of the base 54. The base 54 includes optional retention features for securing the electrical contact 18 to the housing 16 (FIGS. 1 and 2) of the electrical connector 14 (FIGS. 1 and 2). In the exemplary embodiment, the retention features include retention barbs 60 that extend outwardly along sides of the base 54 and engage interior walls of the housing 16 to hold the base 54 within the housing 16. Although eight are shown, the base 54 may include any number of the retention barbs 60. Moreover, in addition or alternatively to the retention barbs 60, the base 54 may include other types of retention features for holding the base 54 within the housing 16.

The mating segment 30 extends outwardly from the base 54 to an end 62. When the base 54 is held within the housing 16, the mating segment 30 extends within the corresponding port 28 of the housing 16 for engagement with the corresponding mating contact of the mating connector. In the exemplary embodiment, the mating segment 30 includes a pair of resiliently deflectable fingers 64 that are spaced apart to define a mating slot 66 therebetween. The mating contact is inserted within the mating slot 66 of the mating segment 30 to mate the electrical contact 18 and the mating contact together. When the mating contact is received within the mating slot 66, each finger 64 of the mating segment 30 engages the mating contact to establish an electrical connection between the electrical contact 18 and the mating contact. In addition or alternatively to the fingers 64, the mating segment 30 may include any other geometry, configuration, and/or the like for mating with the mating contact. For example, in some alternative embodiments, the mating segment 30 includes a pin (not shown) that is received within a receptacle (not shown) of the mating contact.

The EON pins shown and/or described herein (e.g., the EON pins 32, 232, and 332) are not limited to being used as a component of the electrical contacts 18. Rather, the remainder (besides the EON pin 32) of the electrical contact 18 shown and described herein is meant as exemplary only. The EON pins shown and/or described herein may be used as a component of any other type of electrical contact (whether such other type of electrical contact is a component of an electrical device or an intervening electrical connector) and may be used as a component of other electrical contacts having different base and mating segment geometries, configurations, and/or the like than the electrical contacts 18.

Figure 4:
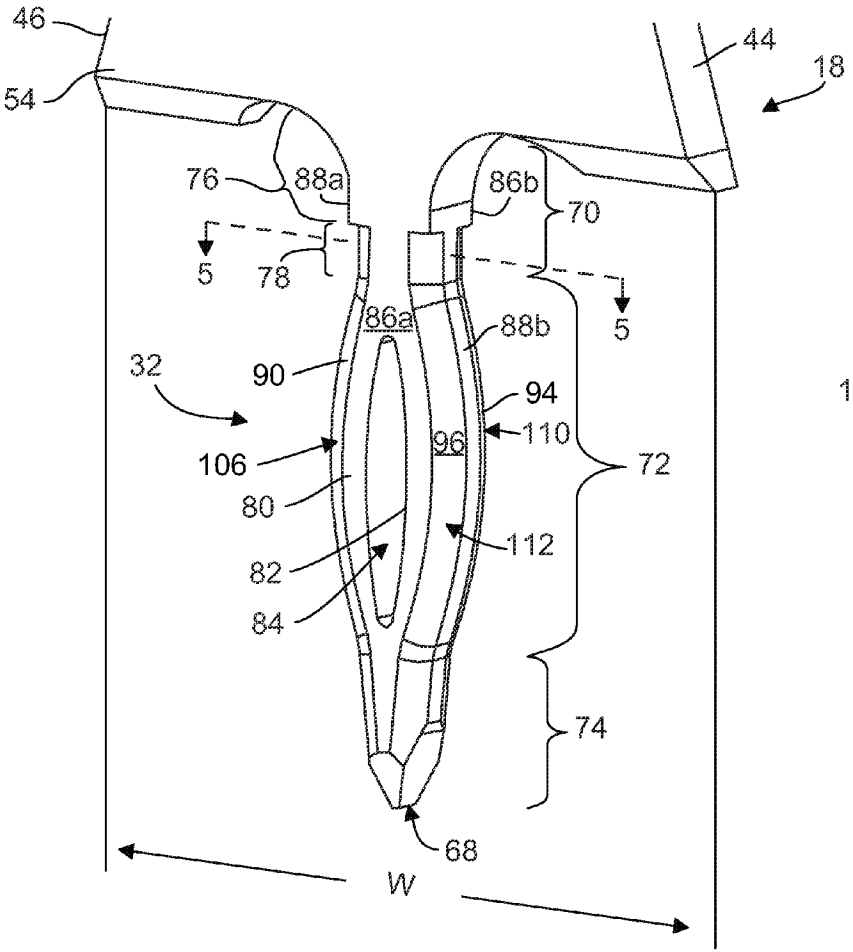
FIG. 4 is a perspective view of a portion of the electrical contact shown in FIG. 3 illustrating an exemplary embodiment of an eye-of-the needle (EON) pin of the electrical contact.

FIG. 4 is a perspective view of a portion of one of the electrical contacts 18 illustrating an exemplary embodiment of the EON pin 32 of the electrical contact 18. The base 54 includes opposite side walls 44 and 46 that define a width W of the base 54 therebetween. The EON pin 32 extends a length outwardly from the base 54 to a tip 68. The EON pin 32 includes a neck segment 70, a compliant segment 72, and a tip segment 74. The neck segment 70 extends outwardly from the base 54. The compliant segment 72 extends outwardly from the neck segment 70, and the tip segment 74 extends outwardly from the compliant segment 72. In other words, the compliant segment 72 extends from the neck segment 70 to the tip segment 74. The tip segment 74 includes the tip 68. The side walls 44 and 46 of the base 54 may each be referred to herein as a "base side wall". The width W of the base 54 may be referred to herein as a "base width".

The neck segment 70 includes a base sub-segment 76 and a via sub-segment 78. The base sub-segment 76 extends outwardly from the base 54. The via sub-segment 78 extends from the base sub-segment 76 to the compliant segment 72. When the EON pin 32 is received within the corresponding electrical via 34 (FIGS. 1 and 6) of the printed circuit 12 (FIG. 1), the via sub-segment 78 extends within the electrical via 34, while at least a portion of the base sub-segment 76 extends outside the electrical via 34. In some embodiments, an entirety of the base sub-segment 76 extends outside the electrical via 34. The compliant segment 72 includes two opposing arms 80 and 82. The arms 80 and 82 are spaced apart to define an opening 84 therebetween. As the EON pin 32 is received within the corresponding electrical via 34, the arms 80 and 82 engage the electrically conductive material on the inner wall of the electrical via 34 and are deflected inwardly toward each other. Engagement between the arms 80 and 82 of the compliant segment 72 and the electrically conductive material of the electrical via 34 electrically connects the EON pin 32 to the electrical via 34.

Figure 5:
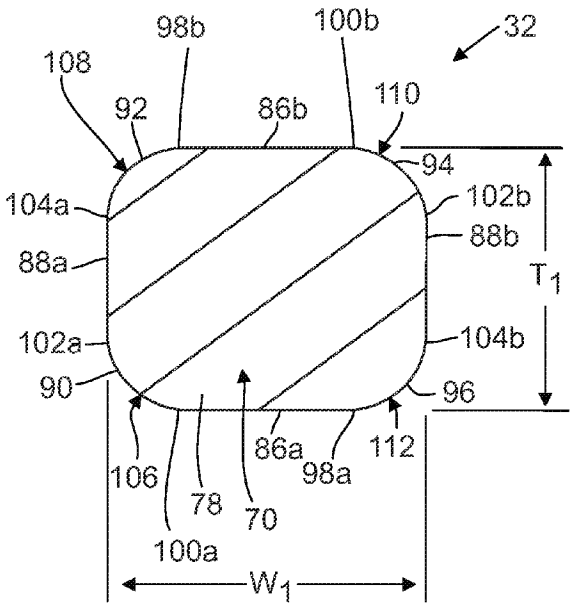
FIG. 5 is a cross-sectional view of the electrical contact shown in FIGS. 3 and 4 taken along line 5-5 of FIG. 4.

FIG. 5 is a cross-sectional view of the electrical contact 18 taken along line 5-5 of FIG. 4. Referring now to FIGS. 4 and 5, the EON pin 32 includes a pair of end walls 86*a* and 86*b* that extend opposite each other, and a pair of side walls 88*a* and 88*b* that extend opposite each other. The side walls 88*a* and 88*b* extend between the end walls 86*a* and 86*b*. Each of the segments 70, 72, and 74 (segments 72 and 74 are not visible in FIG. 5) of the EON pin 32 includes, and is partially defined by, the end walls 86*a* and 86*b* and the side walls 88*a* and 88*b*. As best seen in FIG. 5, at the via sub-segment 78 of the neck segment 70, the end walls 86*a* and 86*b* are spaced apart by a distance that defines a thickness $T_1$ of the via sub-segment 78. As is also best seen in FIG. 5, the side walls 88*a* and 88*b* are spaced apart by a distance at the via sub-segment 78 that defines a width $W_1$ of the via sub-segment 78. As should be apparent from FIG. 4, the width $W_1$ of the via sub-segment 78 of the neck segment 70 is less than the width W of the base 54.

In the exemplary embodiment, the end walls 86*a* and 86*b* extend approximately parallel to each other, but the end walls 86*a* and 86*b* may alternatively extend at an oblique angle relative to each other. The side walls 88*a* and 88*b* also extend approximately parallel to each other in the exemplary embodiment. Alternatively, the side walls 88*a* and 88*b* extend at an oblique angle relative to each other. Although the end walls 86*a* and 86*b* extend approximately perpendicular to the side walls 88*a* and 88*b* in the exemplary embodiment, alternatively the end walls 86*a* and/or 86*b* extends at an oblique angle relative to the side walls 88*a* and/or 88*b*. Each of the side walls 88*a* and 88*b* may be referred to herein as a "neck side wall".

At the neck segment 70, and more particularly at the via sub-segment 78, each end wall 86*a* and 86*b* is connected to each side wall 88*a* and 88*b* at a corresponding transitional wall 90, 92, 94, or 96 (wall 92 is not visible in FIG. 4). Specifically, and referring now solely to FIG. 5, each end wall 86*a* and 86*b* extends from a respective edge 98*a* and 98*b* to an opposite edge 100*a* and 100*b*, respectively. Similarly, each side wall 88*a* and 88*b* extends from an edge 102*a* and 102*b*, respectively, to an opposite edge 104*a* and 104*b*, respectively. As can be seen in FIG. 5, the edge 100*a* of the end wall 86*a* is spaced apart from the edge 102*a* of the side wall 88*a*, and the edge 104*a* of the side wall 88*a* is spaced apart from the edge 98*b* of the end wall 86*b*. The edge 100*b* of the end wall 86*b* is spaced apart from the edge 102*b* of the side wall 88*b*, and the edge 104*b* of the side wall 88*b* is spaced apart from the edge 98*a* of the end wall 86*a*. Each transitional wall 90, 92, 94, and 96 interconnects the spaced-apart edges of the corresponding end and side walls 86 and 88. More particularly, the transitional wall 90 corresponds to the end and side walls 86*a* and 88*a*, respectively. The transitional wall 90 extends from the edge 100*a* of the end wall 86*a* to the edge 102*a* of the side wall 88*a* to interconnect the corresponding end and side walls 86*a* and 88*a*, respectively. The transitional wall 90 defines a corner 106 between the end wall 86*a* and the side wall 88*a*.

The transitional wall 92 corresponds to the side wall 88*a* and the end wall 86*b* and extends from the edge 104*a* of the side wall 88*a* to the edge 98*b* of the end wall 86*b* to interconnect the corresponding side and end walls 88*a* and 86*b*, respectively. The transitional wall 92 defines a corner 108 between the side wall 88*a* and the end wall 86*b*. The transitional wall 94 defines a corner 110 between the end wall 86*b* and the side wall 88*b* and extends from the edge 100*b* of the end wall 86*b* to the edge 102*b* of the side wall 88*b* to interconnect the corresponding end and side walls 86*b* and 88*b*, respectively. The transitional wall 96 extends from the edge 104*b* of the side wall 88*b* to the edge 98*a* of the end wall 86*a* to interconnect the corresponding side and end walls 88*b* and 86*a*, respectively. The transitional wall 96 defines a corner 112 between the side wall 88*b* and the end wall 86*a*. Each of the transitional walls 90, 92, 94, and 96 may be referred to herein as a "neck transitional wall".

In the exemplary embodiment, each of the transitional walls 90, 92, 94, and 96 is curved such that each of the corners 106, 108, 110, and 112 includes a round. The rounded corners 106, 108, 110, and 112 enable the via sub-segment 78 of the neck segment 70 to have a greater width $W_1$ and/or thickness $T_1$ for a given diameter of the corresponding electrical via 34. In other words, even with a greater width $W_1$ and/or thickness $T_1$, the via sub-segment 78 of the EON pin 32 will fit within the same diameter electrical via as an EON pin wherein the side and end walls of the via sub-segment intersect at pointed edges. The increased width $W_1$ and/or thickness $T_1$ of the via sub-segment 78 increases a structural rigidity of the neck segment 70, which may enable the EON pin 32 to be received within the corresponding electrical via 34 without buckling at the neck segment 70.

Figure 6:
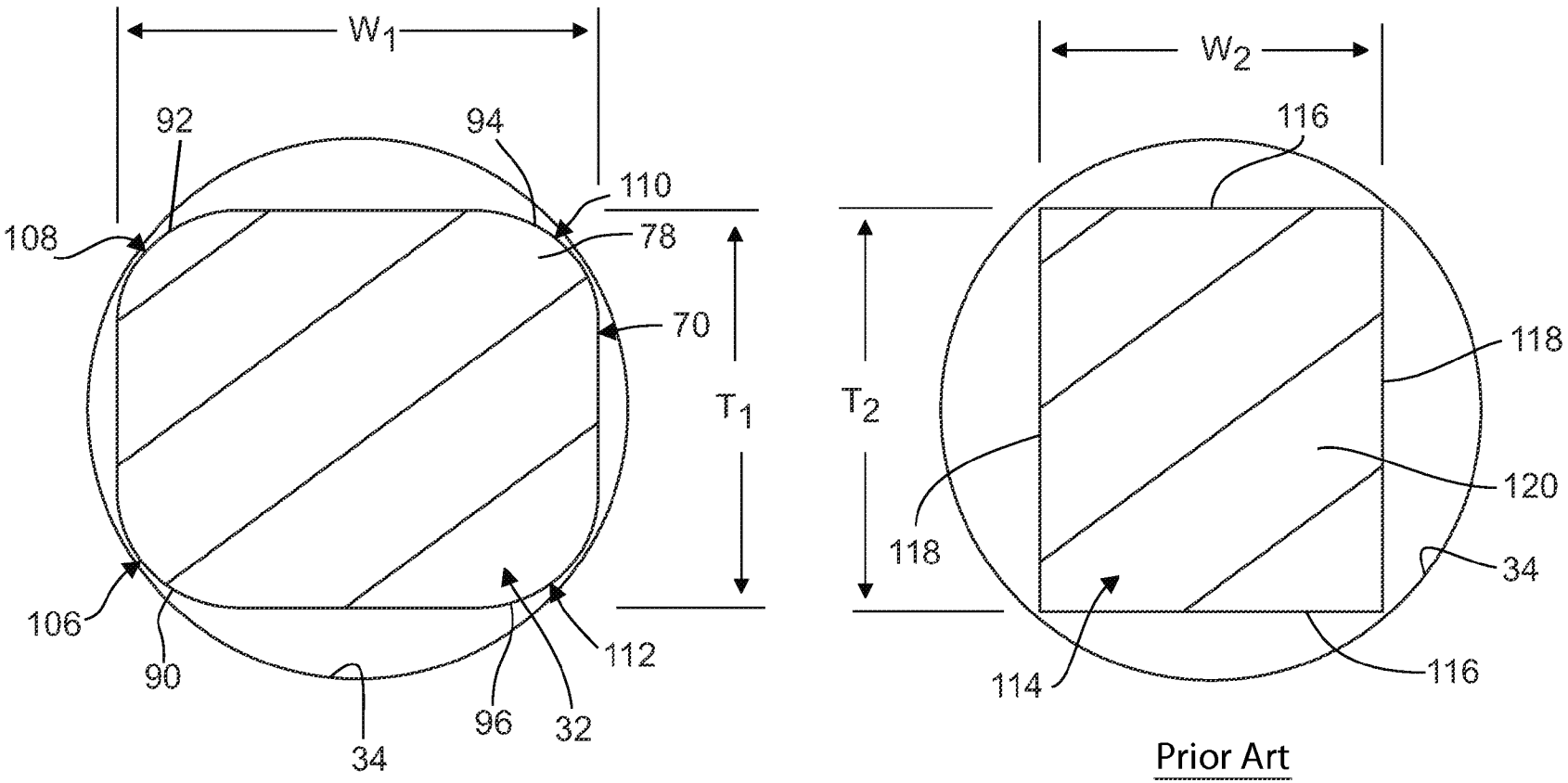
FIG. 6 is a cross sectional view comparing the EON pin shown in FIGS. 4 and 5 to another exemplary EON pin.

FIG. 6 is a cross sectional view comparing the EON pin 32 to an EON pin 114 wherein end and side walls 116 and 118, respectively, of a via sub-segment 120 thereof intersect at pointed edges. FIG. 6 illustrates the via sub-segment 78 of the EON pin 32 received within the corresponding electrical via 34. The via sub-segment 120 of the EON pin 114 is also shown in FIG. 6 received within one of the electrical vias 34. FIG. 6 therefore illustrates the via sub-segments 78 and 120 as being received within electrical vias 34 that have the same diameter. Although the electrical vias 34 may have any diameter, one example of a diameter of the electrical vias 34 shown in FIG. 6 is approximately 0.205 mm. Another example of a diameter of the electrical vias 34 is approximately 0.283 mm. At the via sub-segment 120 of the EON pin 114, the end walls 116 are spaced apart by a distance that defines a thickness $T_2$ of the via sub-segment 120. The side walls 118 are spaced apart by a distance at the via sub-segment 120 that defines a width $W_2$ of the via sub-segment 120.

As can be seen in FIG. 6, the thicknesses $T_1$ and $T_2$ of the via sub-segments 78 and 120, respectively, are approximately equal. Although the thicknesses $T_1$ and $T_2$ may have any value depending on the diameter of the electrical via 34, one example of the thicknesses $T_1$ and $T_2$ is approximately 0.15 mm for an electrical via 34 having a diameter of approximately 0.205 mm. As can also be seen in FIG. 6, the width $W_1$ of the via sub-segment 78 is greater than the width $W_2$ of the via sub-segment 120. Accordingly, the via sub-segment 78 has a greater width $W_1$ than the width $W_2$ of the via sub-segment 120 yet the via sub-segment 78 fits within the same diameter electrical via 34 as the via sub-segment 120. Although the widths $W_1$ and $W_2$ may have any value depending on the diameter of the electrical via 34, one example of the widths $W_1$ and $W_2$ is approximately 0.18 mm and approximately 0.13 mm, respectively, for an electrical via 34 having a diameter of approximately 0.205 mm. Accordingly, for an electrical via 34 having a diameter of approximately 0.205 mm, the via sub-segment 78 may have a width $W_1$ that is greater than the width $W_2$ of the via sub-segment 120 by 0.05 mm or approximately 38%.

The greater width $W_1$ of the via sub-segment 78 than the width $W_2$ of the via sub-segment 120 provides the via sub-segment 78 with an increased structural rigidity as compared to the via sub-segment 120. The greater structural rigidity of the via sub-segment 78 may enable the EON pin 32 to be received within the corresponding electrical via 34 without buckling at the neck segment 70. For example, the structural rigidity of the via sub-segment 78 may exceed the force required to insert the compliant segment 72 (FIG. 4) of the EON pin 32 into the corresponding electrical via 34.

As discussed above, the transitional walls 90, 92, 94, and 96 of the via sub-segment 78 enable the thickness $T_1$ and/or the width $W_1$ of the via sub-segment 78 to be greater than the thickness $T_2$ and/or the width $W_2$ of the via sub-segment 120 for a given diameter electrical via 34. In the exemplary embodiment, only the width $W_1$ of the via sub-segment 78 has been increased (relative to the via sub-segment 120 of the EON pin 114). But, alternatively the thickness $T_1$ or both the width $W_1$ and the thickness $T_1$ of the via sub-segment 78 are increased relative to the via sub-segment 120 of the EON pin 114.

The rounded corners 106, 108, 110, and 112 may each have a round of any radius for enabling the thickness $T_1$ and/or the width $W_1$ to be increased for a given diameter electrical via 34. A greater radius may enable a greater increase in the thickness $T_1$ and/or the width $W_1$. In the exemplary embodiment, the rounded corners 106, 108, 110, and 112 are each provided with a round having a radius of approximately 0.05 mm. But, the 0.05 mm radius rounds are meant as exemplary only. Each corner 106, 108, 110, and 112 may have a round having any radius for providing any amount of increased thickness $T_1$ and/or width $W_1$.

The transitional walls 90, 92, 94, and 96 are not limited to being convexly curved to define the rounded corners 106, 108, 110, and 112. Rather, each corner 106, 108, 110, and 112 may alternatively have a chamfer, a fillet, or a combination of a round, chamfer, and/or fillet. Moreover, in some alternative embodiments, at least one of the corners 106, 108, 110, and/or 112 of the same via sub-segment 78 has a differently shaped transitional wall 90, 92, 94, and/or 96 than at least one other corner 106, 108, 110, and/or 112 of the via sub-segment 78. For example, one of the corners 106, 108, 110, or 112 may include a round while another of the corners 106, 108, 110, or 112 includes a chamfer, a fillet, or a combination of a round, chamfer, and/or fillet.

Figure 7:
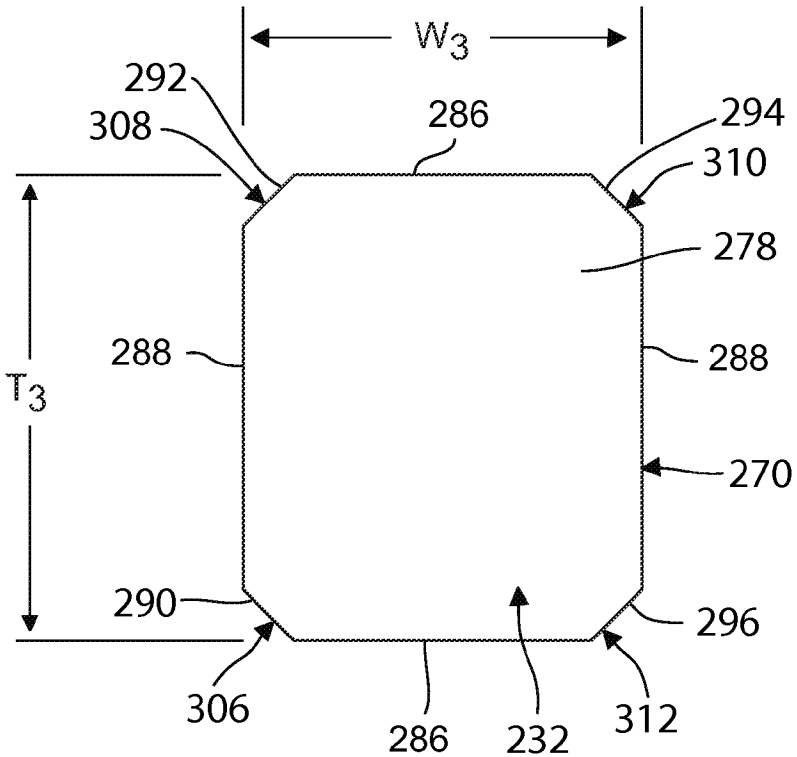
FIG. 7 is a cross-sectional view of an exemplary alternative embodiment of an EON pin.

FIG. 7 is a cross-sectional view of an exemplary alternative embodiment of a via sub-segment 278 of a neck segment 270 of an EON pin 232 illustrating chamfered corners. The EON pin 232 includes end walls 286 that are spaced apart by a distance that defines a thickness $T_3$ of the via sub-segment 278, and side walls 288 that are spaced apart by a distance that defines a width $W_3$ of the via sub-segment 278. Each end wall 286 is connected to each side wall 288 at a corresponding transitional wall 290, 292, 294, or 296. The transitional walls 290, 292, 294, and 296 define respective corners 306, 308, 310, and 312 between the end walls 286 and the side walls 288. Each of the transitional walls 290, 292, 294, and 296 is approximately planar and is angled obliquely to the end walls 286 and the side walls 288 such that each of the corners 306, 308, 310, and 312 includes a chamfer. The chamfered corners 306, 308, 310, and 312 enable the via sub-segment 278 to have a greater width $W_3$ and/or thickness $T_3$ than the via sub-segment 120 (FIG. 6) of the EON pin 114 (FIG. 6) yet still fit within the same diameter electrical via 34. The increased width $W_3$ and/or thickness $T_3$ of the via sub-segment 278 increases a structural rigidity of the neck segment 270, which may enable the EON pin 232 to be received within the corresponding electrical via 34 without buckling at the neck segment 270. In the exemplary embodiment of FIG. 7, the thickness $T_3$ has been increased relative to the thickness $T_2$ (FIG. 6) of the via sub-segment 120 of the EON pin 114.

Figure 8:
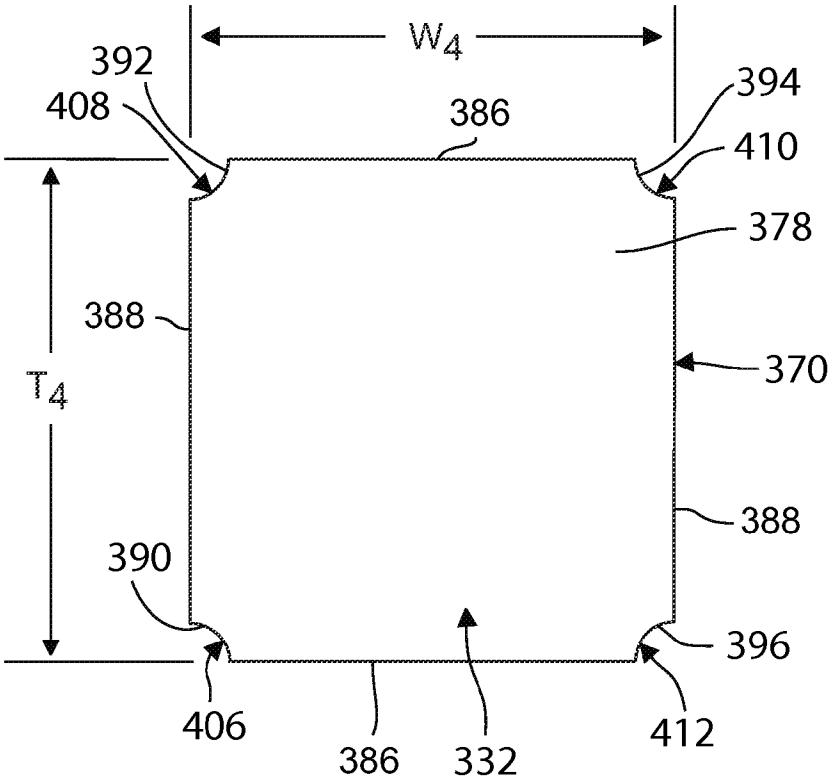
FIG. 8 is a cross-sectional view of another exemplary alternative embodiment of an EON pin.

FIG. 8 is a cross-sectional view of an exemplary alternative embodiment of a via sub-segment 378 of a neck segment 370 of an EON pin 332 illustrating filleted corners. The EON pin 332 includes end walls 386 that are spaced apart by a distance that defines a thickness $T_4$ of the via sub-segment 378, and side walls 388 that are spaced apart by a distance that defines a width $W_4$ of the via sub-segment 378. Each end wall 386 is connected to each side wall 388 at a corresponding transitional wall 390, 392, 394, or 396. The transitional walls 390, 392, 394, and 396 define respective corners 406, 408, 410, and 412 between the end walls 386 and the side walls 388. Each of the transitional walls 390, 392, 394, and 396 is curved and includes a concave shape such that each of the corners 406, 408, 410, and 412 includes a fillet. The filleted corners 406. 408, 410, and 412 enable the via sub-segment 378 to have a greater width $W_4$ and/or thickness $T_4$ than the via sub-segment 120 (FIG. 6) of the EON pin 114 (FIG. 6) yet still fit within the same diameter electrical via 34. The increased width $W_4$ and/or thickness $T_4$ of the via sub-segment 378 increases a structural rigidity of the neck segment 370, which may enable the EON pin 332 to be received within the corresponding electrical via 34 without buckling at the neck segment 370. In the exemplary embodiment of FIG. 8, both the width $W_4$ and the thickness $T_4$ have been increased relative to the width $W_2$ (FIG. 6) and thickness $T_2$ (FIG. 6) of the via sub-segment 120 of the EON pin 114.

Referring again to FIG. 4, in the exemplary embodiment, the compliant segment 72 and the tip segment 74 both include the transitional walls 90, 92, 94, and 96 (the wall 92 is not visible in FIG. 4). Accordingly, both the compliant segment 72 and the tip segment 74 include the rounded corners 106, 108, 110, and 112 (the corner 108 is not visible in FIG. 4). Alternatively, the compliant segment 72 and/or the tip segment 74 do not include the transitional walls 90, 92, 94, and 96 and therefore do not include the corners 106, 108, 110, and 112. Rather, in such alternative embodiments, the end walls 86 and the side walls 88 intersect at pointed edges along the compliant segment 72 and/or the tip segment 74. Moreover, the compliant segment 72 and the tip segment 74 are not limited to the rounded corners 106, 108, 110, and 112. Rather, both the compliant segment 72 and the tip segment 74 may include corners 106, 108, 110, and 112 that have a chamfer, a fillet, or a combination of a round, chamfer, and/or fillet.

As used herein, the term "printed circuit" is intended to mean any electric circuit in which the conducting connections have been printed or otherwise deposited in predetermined patterns on an electrically insulating substrate. The substrate 48 of the printed circuit 12 may be a flexible substrate or a rigid substrate. The substrate 48 may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate 48 is a rigid substrate fabricated from epoxy-glass, such that the printed circuit 12 is what is sometimes referred to as a "circuit board" or a "printed circuit board".

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the above description and the drawings. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical contact comprising:

a base; and an eye-of-the needle (EON) pin extending a length outwardly from the base to a tip, the EON pin being configured to be received within an electrical via, the EON pin comprising a neck segment that extends outwardly from the base, a tip segment that includes the tip, and a compliant segment that extends from the neck segment to the tip segment, the neck segment having opposite end walls and opposite side walls that extend between the end walls, the end walls being connected to the side walls at corresponding transitional walls that interconnect spaced-apart edges of the corresponding end and side walls.

2. The electrical contact according to claim 1, wherein the transitional walls define corners between the corresponding end and side walls, at least one of the corners comprising one of a round, a fillet, or a chamfer.

3. The electrical contact according to claim 1, wherein at least one of the transitional walls is curved.

4. The electrical contact according to claim 1, wherein at least one of the transitional walls extends obliquely to the corresponding end and side walls.

5. The electrical contact according to claim 1, wherein a cross section taken through the neck segment in a direction perpendicular to the length of the EON pin is non-rectangular.

6. The electrical contact according to claim 1, wherein the side walls are neck side walls that are spaced apart by a neck width, the base comprising opposite base side walls that are spaced apart by a base width, the base width being greater than the neck width.

7. The electrical contact according to claim 1, wherein the transitional walls are neck transitional walls, the tip segment comprising the end and side walls, and wherein at the tip segment the end walls are connected to the side walls at corresponding tip transitional walls that interconnect spaced-apart edges of the corresponding end and side walls.

8. The electrical contact according to claim 1, wherein the end walls extend approximately perpendicular to the side walls.

9. The electrical contact according to claim 1, wherein the compliant segment comprises two opposing arms and an opening defined between the arms.

10. An electrical contact comprising:

a base; and an eye-of-the needle (EON) pin extending a length outwardly from the base to a tip, the EON pin being configured to be received within an electrical via, the EON pin comprising a neck segment that extends outwardly from the base, a tip segment that includes the tip, and a compliant segment that extends from the neck segment to the tip segment, the neck segment having opposite end walls and opposite side walls that extend between the end walls, the end walls being connected to the side walls at corresponding transitional walls that define corners between the corresponding end and side walls, wherein the corners comprise at least one of a round, a fillet, or a chamfer.

11. The electrical contact according to claim 10, wherein at least one of the transitional walls extends obliquely to the corresponding end and side walls.

12. The electrical contact according to claim 10, wherein a cross section taken through the neck segment in a direction perpendicular to the length of the EON pin is non-rectangular.

13. The electrical contact according to claim 10, wherein the side walls are neck side walls that are spaced apart by a neck width, the base comprising opposite base side walls that are spaced apart by a base width, the base width being greater than the neck width.

14. The electrical contact according to claim 10, wherein the compliant segment comprises two opposing arms and an opening defined between the arms.

15. The electrical contact according to claim 10, wherein the end walls extend approximately perpendicular to the side walls.

16. The electrical contact according to claim 10, wherein the transitional walls are neck transitional walls, the tip segment comprising the end and side walls, and wherein at the tip segment the end walls are connected to the side walls at corresponding tip transitional walls, the tip transitional walls comprising at least one of a round, a fillet, or a chamfer.

17. An electrical contact comprising:

a base; and an eye-of-the needle (EON) pin extending a length outwardly from the base to a tip, the EON pin being configured to be received within an electrical via, the EON pin comprising a neck segment that extends outwardly from the base, a tip segment that includes the tip, and a compliant segment that extends from the neck segment to the tip segment, the neck segment including opposite end walls and opposite side walls that extend between the end walls, the end walls being connected to the side walls of corresponding transitional walls, wherein a cross section taken through the neck segment in a direction perpendicular to the length of the EON pin is non-rectangular, and wherein at least one of the transitional walls is curved.

18. The electrical contact according to claim 17, wherein the compliant segment comprises two opposing arms and an opening defined between the arms.

19. The electrical contact according to claim 17, wherein at least one of the transitional walls extends obliquely to the corresponding end and side walls.

* * * * *